US005337876A

United States Patent [19]

McGee et al.

[11] Patent Number: 5,337,876

[45] Date of Patent: Aug. 16, 1994

[54] COUNTER-TOP VENDING MACHINE

[75] Inventors: Jeffrey S. McGee, San Diego; Joseph E. Fesi, Hopatcong, N.J.; John F. Murphy, San Diego, all of Calif.

[73] Assignee: American District Enterprises, Inc., Parsippany, N.J.

[21] Appl. No.: 55,721

[22] Filed: Apr. 30, 1993

[51] Int. Cl.[5] ..... G07F 11/52

[52] U.S. Cl. ..... 194/236; 221/75; 221/126

[58] Field of Search ..... 221/127, 75, 123, 131, 221/126; 194/236, 342, 343

[56] References Cited

U.S. PATENT DOCUMENTS

| | | | |
|---|---|---|---|
| 1,283,429 | 10/1918 | Tily et al. | 221/126 X |
| 1,959,084 | 5/1934 | Nicholson | 221/126 |
| 2,064,843 | 12/1936 | Mills | 221/127 X |
| 2,263,496 | 11/1941 | Harris | 221/127 |
| 2,524,673 | 10/1950 | Martin | 221/126 X |
| 2,656,029 | 10/1953 | Spero et al. | 221/126 X |
| 3,344,953 | 10/1967 | Krakaver et al. | 221/75 |
| 3,351,233 | 11/1967 | Chanoch et al. | 221/131 X |
| 3,575,272 | 4/1971 | Hildebrand | 194/342 |
| 4,023,704 | 5/1977 | Pitel et al. | 221/75 |
| 4,560,088 | 12/1985 | Tan | 221/75 |
| 4,721,197 | 1/1988 | Hoffman . | |
| 4,744,490 | 5/1988 | Albright et al. | 221/75 |

FOREIGN PATENT DOCUMENTS

| | | | |
|---|---|---|---|
| 1140917 | 8/1957 | France | 221/126 |
| 872244 | 7/1961 | United Kingdom | 221/126 |

OTHER PUBLICATIONS

TKW Mini Snack Vendors (2 pages) undated.
TKW Wall Mount Snack Vendors (2 pages) undated.
Snackmate (2 pages), brochure dated Oct. 1990.
Ad for Polyvend machine dated Jun. 1992 (one page).
Ads for Venex and The Vendor's Choice dated Jun. 1992 (one page).
9500 Series Coin Mech. (two pages) (undated).
Ads for Rowe, Snak-Stix, and PPD Corporation Vending Machines (one page), Jun. 1992.

*Primary Examiner*—David A. Bucci
*Assistant Examiner*—Scott L. Lowe
*Attorney, Agent, or Firm*—Baker, Maxham, Jester & Meador

[57] ABSTRACT

A vending machine has an outer housing with a hollow interior and a manual retrieval opening. At least one tray is removably supported by the housing inside the interior thereof. The tray has a plurality of storage bins, each bin being dimensioned for receiving a plurality of items to be dispensed. Each bin has a movably actuable mechanism for ejecting a single unit of the item therefrom. A manually operable coin mechanism is mounted to an exterior of the housing for receiving a predetermined number and size of coins. Insertion of the proper coins into the coin mechanism permits a single actuation thereof through a predefined range of motion. A manually operable selector mechanism is mounted to the exterior of the housing for designating the item to be dispensed when moved into engagement with the ejecting mechanism of a preselected one of the plurality of storage bins. A drive mechanism is coupled between the coin mechanism and the selector mechanism for enabling the predefined range of motion imparted by a single actuation of the coin mechanism to actuate the ejecting means of the preselected one of the storage bins. This causes a single unit of the item stored therein to be dispensed to the manual retrieval opening of the housing.

9 Claims, 5 Drawing Sheets

COUNTER-TOP VENDING MACHINE

BACKGROUND OF THE INVENTION

The present invention relates to coin operated devices for vending snack food items, and more particularly, to small manually driven vending machines.

Small offices such as banks, real estate companies and law firms typically do not have any snack food service if they have fewer than eighty employees. Snack food vending machines are usually large vertical cabinets housing complicated electro-mechanical dispensing mechanisms. Many small offices do not have sufficient space for large vending machines. Even if they have the extra space, the monthly dollar volume of snacks purchased by the relatively low number of employees in a small office does not justify the placement of a large vending machine. This is because such machines cost between two and three thousand dollars apiece.

Snack food service is sometimes provided to small offices through a so-called "honor box." This is an open cardboard tray supporting a small selection of pre-packaged chips, candy bars, cakes, sweet rolls and the like. Office workers can freely retrieve any of these snack food items from the tray and are "on their honor" to deposit sufficient coins in a rudimentary cash box to cover the posted price. Historically honor boxes have experienced a high rate of theft, i.e. 20–30%. They also do not provide protection against rodents.

During the past ten years a new class of counter-top vending machines has been developed. Their relatively small size permits them to be placed on a counter-top of an office kitchen. See for example U.S. Pat. No. 4,721,197 of Hoffman. Existing counter-top vending machines are bulky and heavy and are usually too costly to justify a route. The price of commercially available counter-top vending machines currently ranges between $300 and $1500. Service of most counter-top vending machines is limited to item-by-item re-stock at the office location, which is time consuming and disruptive to the office staff. Existing counter-top vending machines have multiple coin mechanisms which are not easy to re-coin when it is necessary to change the price of items being vended. Also their item selection mechanisms are difficult for a customer to use and are unreliable. For example, one small vending machine has a manually movable rod tipped with a pressure sensitive adhesive which is lowered until it sticks to the article selected. The rod is then raised and moved to an accessible location where the purchased article is grasped and removed by the customer.

SUMMARY OF THE INVENTION

It is therefore the primary object of the present invention to provide an improved low cost counter-top vending machine which is lightweight, compact, durable, simple to operate, easy to re-coin, and capable of rapid re-stock.

In accordance with my invention, a vending machine has an outer housing with a hollow interior and a manual retrieval opening. At least one tray is removably supported by the housing inside the interior thereof. The tray has a plurality of storage bins, each bin being dimensioned for receiving a plurality of items to be dispensed. Each bin has a movably actuable mechanism for ejecting a single unit of the item therefrom. A manually operable coin mechanism is mounted to an exterior of the housing for receiving a predetermined number and size of coins. Insertion of the proper coins into the coin mechanism permits a single actuation thereof through a predefined range of motion. A manually operable selector mechanism is mounted to the exterior of the housing for designating the item to be dispensed when moved into engagement with the ejecting mechanism of a preselected one of the plurality of storage bins. A drive mechanism is coupled between the coin mechanism and the selector mechanism for enabling the predefined range of motion imparted by a single actuation of the coin mechanism to actuate the ejecting means of the preselected one of the storage bins. This causes a single unit of the item stored therein to be dispensed to the manual retrieval opening of the housing.

DESCRIPTION OF THE PREFERRED EMBODIMENT

Figure 1:
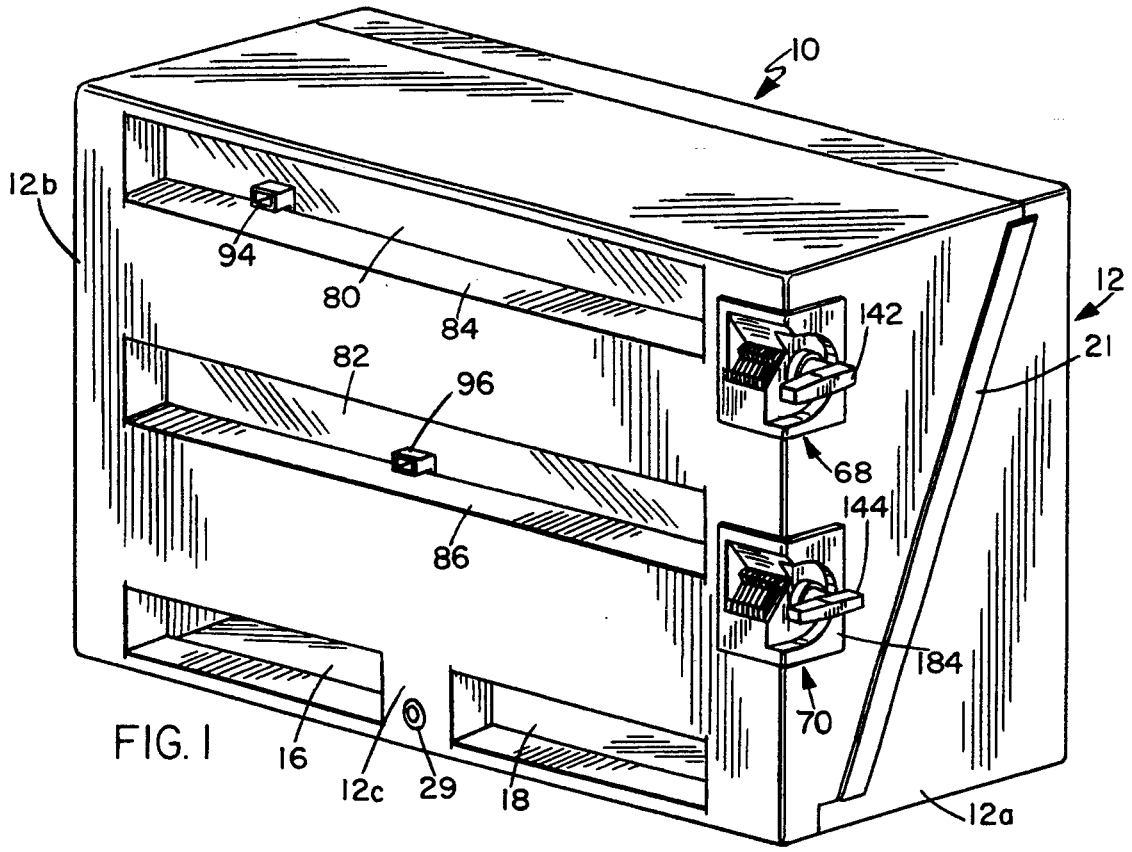
FIG. 1 is a perspective view of a preferred embodiment of our counter-top vending machine.
Figure 2:
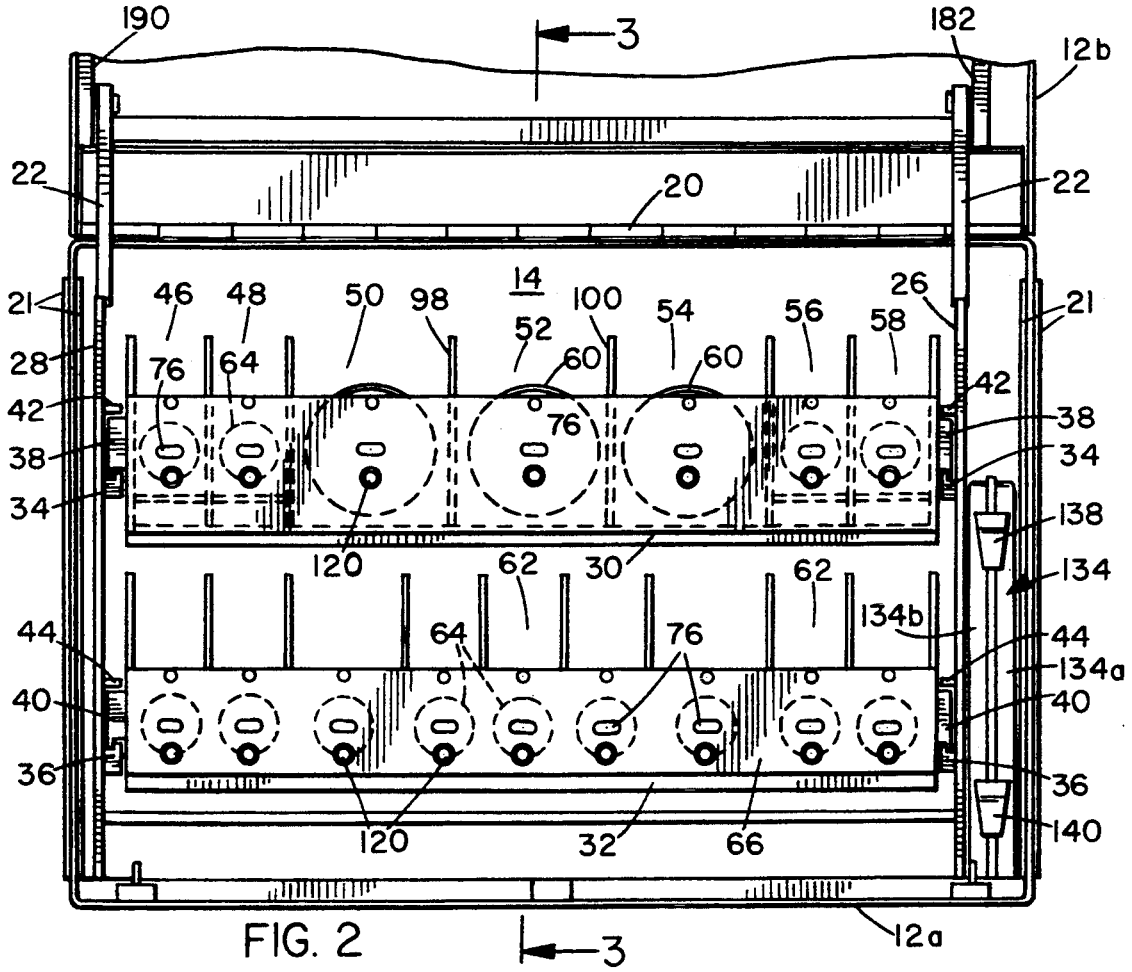
FIG. 2 is a front elevation view of the preferred embodiment of our counter-top vending machine with its lid portion raised to permit access to upper and lower snack trays.

Referring to FIGS. 1 and 2, a counter-top vending machine 10 constructed in accordance with our invention includes an outer box-shaped housing 12 having a hollow interior 14 and a pair of manual snack retrieval openings 16 and 18. The housing is split or divided along a diagonal into a lower base portion 12*a* and an upper lid portion 12*b* which are pivotally connected by a hinge 20. The diagonal edge of the lid portion 12*b* is received between pairs of spaced apart guide flanges 21 attached to opposite sides of the diagonal edges of the base portion 12*a*. An H-shaped lid stay 22 is pivotally connected to the lid portion 12*b* for engaging notches 24 (FIG. 3) in the upper edges a pair of vertical sidewalls 26 and 28 mounted at opposite ends of the base portion 12*a*. As shown in phantom lines in FIG. 3, this construction allows the stay 22 to support the lid portion 12*b* in a raised position. A lock 29 (FIG. 1) is mounted on a center post 12*c* of the housing 12. A key (not illustrated) may be inserted into the lock 29 and rotated to move a pair of locking pins (not illustrated) into and out of holes in the sidewalls 26 and 28. The linkage between the lock 29 and the locking pins may be conventional such as a bell crank and a pair of tie rods.

A pair of removable snack trays 30 and 32 (FIG. 2) are slidingly supported at their opposite ends by upper and lower horizontally extending tracks 34 and 36 secured to the inside of sidewalls 26 and 28 of the housing 12. The ends of the trays 30 and 32 have horizontally extending rails 38 and 40 attached thereto which slide in the tracks 34 and 36, respectively. Pins 42 and 44 which are fixed in the sidewalls 26 and 28 prevent the trays 30 and 32 from tipping upwardly when slid out of the housing 12 on the tracks 34 and 36. Other pins (not illustrated) are fixed in the sidewalls 26 and 28 to limit the extent of the sliding of each of the trays 30 and 32 into the housing 12.

Figure 3:
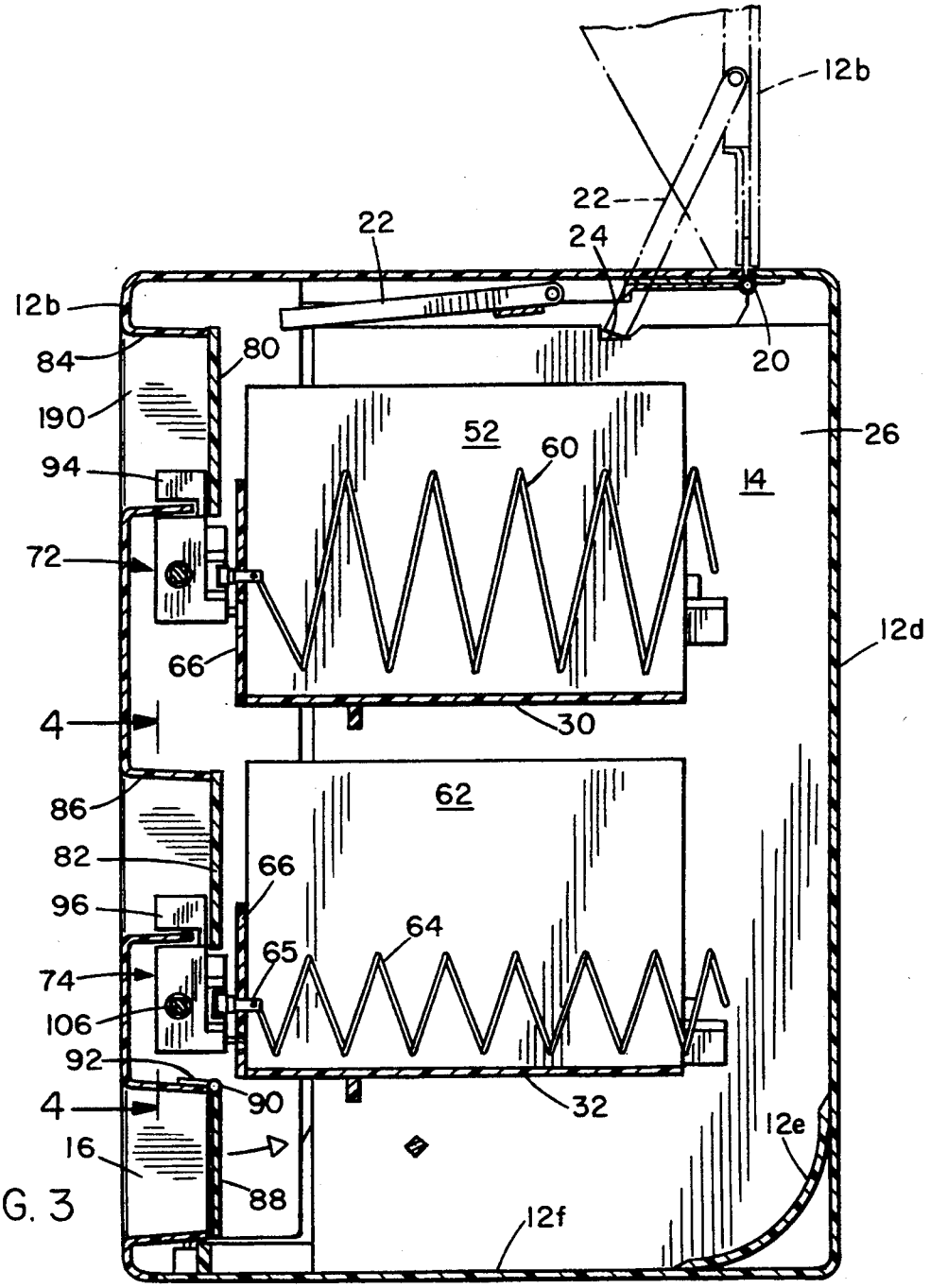
FIG. 3 is an enlarged vertical sectional view of the preferred embodiment of our counter-top vending machine taken along line 3—3 of FIG. 2.
Figure 4:
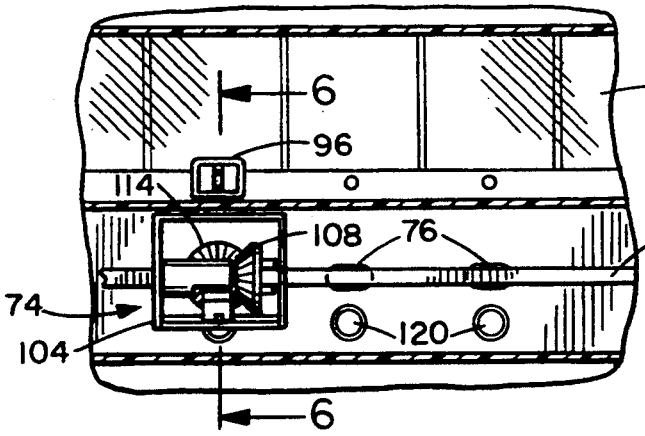
FIG. 4 is a sectional view taken along line 4—4 of FIG. 3 illustrating details of the lower selector mechanism and lower drive mechanism of the preferred embodiment of our counter-top vending machine.

Each tray such as 30 (FIG. 2) has a plurality of elongated storage bins such as 46, 48, 50, 52, 54, 56 and 58. Each storage bin is dimensioned for receiving a plurality of snack items to be dispensed. These include, by way of example, pre-packaged chips, candy bars, cakes, sweet rolls and the like. The smaller bins 46, 48, 56 and 58 hold smaller snacks such as candy bars. The larger bins 50, 52 and 54 hold larger snacks such as bags of potato chips. Each of the larger bins has movably actuable means for ejecting a single unit of the item therefrom including a helical coil 60 (FIG. 3). The smaller bins, such as bin 62 (FIG. 2) have smaller diameter helical coils such as 64 (FIG. 3). The forward end of each helical coil is connected to a spindle 65 (FIGS. 3 and 6) which is journaled in a hole in a transverse forward wall such as 66 of the corresponding tray. The wall 66 forms the closed forward end of each of the bins of the corresponding tray. Each of the bins is open at its rearward end.

A pair of manually operable coin mechanisms 68 and 70 (FIG. 1) are mounted to the exterior right side of the lid portion 12*b* of the housing 12 for receiving a predetermined number and size of coins. Insertion of the proper coins into one of the coin mechanisms 68 or 70 permits a single actuation thereof through a predefined range of motion. In the preferred embodiment, this range of motion is 360 degrees.

Figure 6:
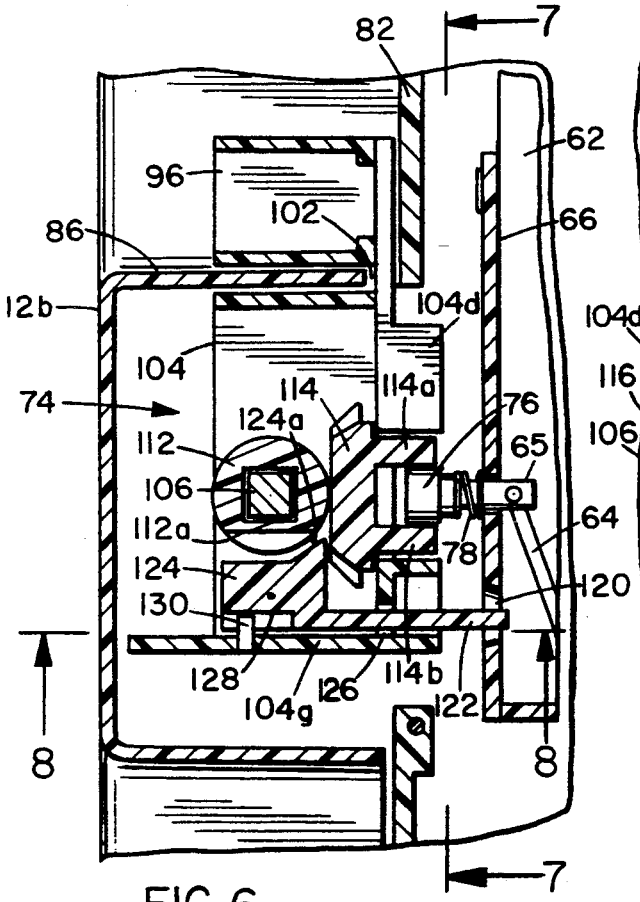
FIG. 6 is an enlarged vertical sectional view taken along line 6—6 of FIG. 4 illustrating further details of the selector mechanism of the preferred embodiment of our counter-top vending machine.
Figure 7:
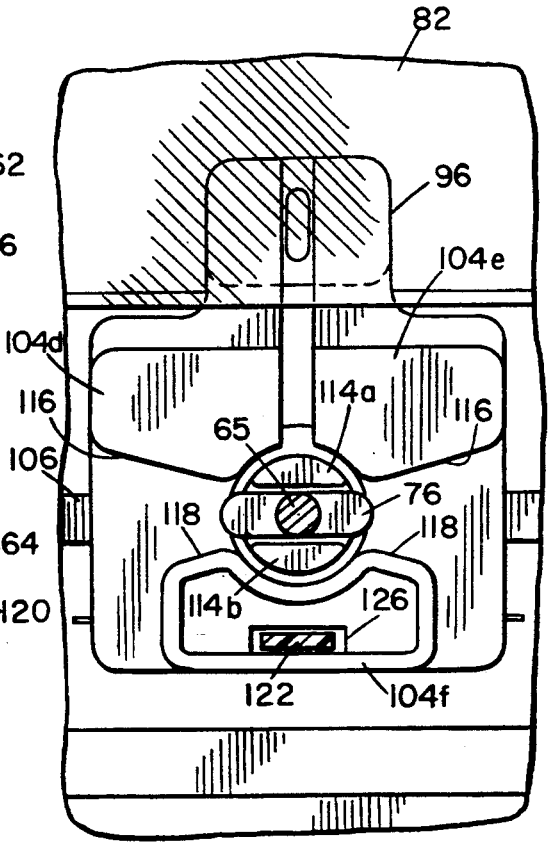
FIG. 7 is a vertical sectional view taken along line 7—7 of FIG. 6 illustrating further details of the selector mechanism of the preferred embodiment of our counter-top vending machine.

Upper and lower manually operable selector mechanisms 72 and 74 (FIG. 3) are mounted to the forward wall of the lid portion 12*b* of the housing 12 for designating the item to be dispensed. This is done by moving either selector mechanism into engagement with the ejecting mechanism of a preselected one of the plurality of storage bins. By way of example, the ejecting mechanism of bin 62 includes helical coil 64, spindle 65 and a rotor 76 (FIGS. 6 and 7). A spring 78 surrounds the spindle 65 between the wall 66 and the rotor 76 so that the rotor is held in proper position but can yield rearwardly. A drive mechanism described later on is coupled between each of the coin mechanisms 68 and 70 and its corresponding selector mechanism 72 or 74 for enabling the predefined range of motion imparted by a single actuation of the coin mechanism to actuate the ejecting means of the preselected one of the storage bins. This causes a single unit of the snack item stored therein to be ejected rearwardly and then dispensed to one of the manual snack retrieval openings 16 and 18 of the housing 12.

The preferred embodiment 10 of our counter-top vending machine has a pair of upper and lower transparent windows 80 and 82 (FIG. 1) which allow a customer to view the various snacks stored in the bins of the upper and lower snack trays 30 and 32. As best seen in FIG. 3, the lid 12*b* is formed with a pair of openings 84 and 86. The base portion 12*a* and lid portion 12*b* of the housing 12 are preferably molded out of suitable plastic. The upper and lower transparent windows 80 and 82 are adhesively attached to inwardly formed flanges of the lid portion 12*b* of the housing.

Each of the manual snack retrieval openings such as 16 is covered by a door such as 88. The door is attached by a hinge 90 for rearward pivoting motion in the direction indicated by the arrow in FIG. 3. A torsion spring 92 associated with the hinge 90 biases the door 88 toward its closed position illustrated in FIG. 3. The door which covers the manual retrieval openings 16 and 18 prevents rodents from gaining access to the hollow interior 14 of the housing 12 which would permit them to feed on the snacks. The door also makes it difficult for a person to reach his or her arm through a retrieval opening in order to pull a snack from the rear of the lower tray 32.

Referring still to FIG. 3, the snacks stored in the bins such as 52 and 62 are individually supported between a single turn of each of the helical coils such as 60 and 64. Rotation of any given coil through one revolution will eject a snack from the corresponding bin into the rear of the hollow interior 14 of the housing 12. There is sufficient clearance between the rear of each of the trays 30 and 32 and the rear vertical wall 12*d* of the housing 12 to permit the ejected snack to fall downwardly onto a curved ramp 12*e* of the housing 12. The curved ramp 12*e* translates the vertical momentum of the snack into horizontal momentum. The snack slides forwardly along the bottom wall 12*f* of the housing until it strikes one of the doors, such as 88, covering the manual snack retrieval openings 16 and 18. The customer may then depress the door 88 rearwardly with his or her fingers and retrieve the vended snack. Should the snack end up behind the center post 12*c*, the width of the post is sufficiently narrow that the snack can be grasped through one of the manual snack retrieval openings 16 and 18.

Preferrably the height of the housing 12 is less than eighteen inches so that it will fit between a kitchen counter-top and a standard height kitchen cabinet. Alternatively, the vending machine 10 may be mounted to a wall by fastening screws, molleys, etc. through mounting holes (not illustrated) in the rear vertical wall 12*d*. Since the lid portion 12*b* is locked to the base portion 12*a*, only the route driver can access these screws or molleys. Theft of the vending machine is thereby made more difficult.

The upper and lower selector mechanisms 72 and 74 include selection levers 94 and 96 (FIGS. 1 and 3), respectively. The portion of either of the selection levers 94 and 96 visible in FIG. 1 can be grasped between a customer's index and thumb and slid laterally left and right to select the bin from which a desired snack will be dispensed. A selection is made by positioning the selection lever in the middle of the selected bin.

As best seen in FIGS. 2 and 3, each tray such as 30 has a generally rectangular configuration including bottom, side and front walls, and partitions, such as 98 and 100 which define the bins. Each bin has no rear wall so that the selected snack can be ejected therefrom. As best seen in FIG. 3, the helical coils such as 60 and 64 rest inside of the bins with their longitudinal axes extending horizontally between the front and rear of the housing 12.

Figure 8:
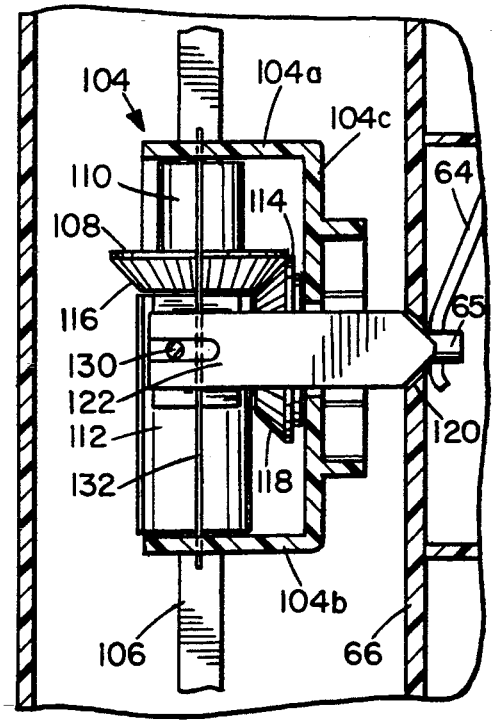
FIG. 8 is a horizontal sectional view taken along line 8—8 of FIG. 6 illustrating further details of the selector mechanism and drive mechanism of the preferred embodiment of our counter-top vending machine.

The upper and lower selector mechanisms 72 and 74 (FIG. 3) are identical in construction and operation. Therefore, it will be sufficient to describe construction and operation of the lower selector mechanism 74. These details are illustrated in FIGS. 4 and 6–8. The selection lever 96 extends downwardly through a gap 102 (FIG. 6) between the transparent window 82 and the horizontal flange of the lid portion **12*b* of the housing defining the window opening 86. The selection lever 96 is connected to the upper side of a box-like gear housing 104. A drive shaft 106 extends horizontally through the gear housing 104 through aligned holes formed in the opposite side walls 104*a* and 104*b* (FIG. 8) of the housing 104. The drive shaft 106 has a square cross-section. A first bevel gear 108 with a square hole is slidably mounted on the drive shaft 106. The bevel gear 108 is maintained in position between the side walls 104*a* and 104*b* of the gear housing 104 by cylindrical bushings 110 and 112 (FIG. 8). These bushings have square-shaped bores so that they can slide along the shaft 106 with the gear housing 104 and bevel gear 108 and will rotate with drive shaft 106**.

A second bevel gear 114 (FIGS. 4 and 6) has a toothed forward side which meshes with the mating toothed portion of the first bevel gear 108 as best seen in FIG. 8. The rear side of the second bevel gear 114 is formed with a pair of projections **114*a* and 114*b* (FIGS. 6 and 7) which define a slot for receiving therein any of the rotors 76 connected to the helical coils of the lower tray 32. The second bevel gear 114 is supported for rotation in a hole formed in the rear wall 104*c* (FIG. 8) of the box-like gear housing 104. Referring to FIG. 6, the spindle 65, rotor 76 and spring 78 provide a first drive coupling between the selector mechanism 74 and the coil of a selected bin such as coil 64. The bevel bears 108 and 114 provide a second drive coupling for engaging the first drive coupling of a selected one of the storage bins. The drive shaft 106 is connected to the coin mechanism 70 (FIG. 1) so that manual rotation of the coin mechanism 70 through one revolution will rotate the coil 64 through one revolution. This ejects a single snack from a bin such as 62. The snack drops down onto the curved ramp portion 12*e* of the housing from which it slides to either of the manual snack retrieval openings 16 and 18**.

In order for the upper and lower snack trays 30 and 32 to be installed inside the housing 12 the lid portion **12*b* must be in its raised position illustrated in FIGS. 2 and 3. The lid portion 12*b* carries the upper and lower coin mechanisms 68 and 70, the upper and lower selector mechanisms 72 and 74, and the associated drive shafts connecting these components. The snack trays 30 and 32 can be loaded at a location remote from the counter-top vending machine 10. The route driver can then deliver the loaded snack trays to the location of the counter-top vending machine. The loaded trays are installed into the housing 12 with each of the rotors 76 extending horizontally as seen in FIG. 2**.

Before the lid portion **12*b* is raised, each of the selection levers 94 and 96 is moved into alignment with one of the partitions, such as 98, of its associated tray. This disengages each of the selector mechanisms 72 and 74 with any of the rotors 76. This in turn prevents damage to the rotors or selector mechanisms when the lid portion 12*b* is raised. The lock 29 may be unlocked with a key and the lid portion 12*b* raised and held in the raised position by engagement of the stay 22 with the notches 24 in the side walls 26 and 28. The empty, or partially empty snack trays 30 and 32 which are already in the vending machine 10 may be removed. The new loaded snack trays are then slid into position in the two-tiered arrangement illustrated in FIG. 2**.

When loading a tray with snacks, the helical coil in each bin is first rotated to the proper orientation. The helical coil is then loaded with snacks so that its rotor 76 extends horizontally as illustrated in FIG. 2. Thus, once the upper and lower trays are installed and the lid portion **12*b* closed, the selection levers 94 and 96 may be slid laterally. The rotors 76 will slide through the slots formed between the projections 114*a* and 114*b* (FIG. 6) on the rearside of each of the second bevel gears 114. The rear wall 104*c* of the box-like gear housing 104 of each of the selector mechanisms is formed with projections 104*d*, 104*e* and 104*f* (FIG. 7). These projections define tapered surfaces 116 and 118 which serve to engage the rotors 76 if they are partially out of horizontal alignment in order to feed the rotors through the slot in the rearside of the corresponding second bevel gear 114. Preferably, the selection lever 96, box-like gear housing 104, and projections 104*d*, 104*e*, and 104*f* are all integrally molded as a single piece of plastic, to facilitate inexpensive construction and rapid assembly. The drive shaft 106** is preferably metal so that it will not sag along its length.

The preferred embodiment of our counter-top vending machine 10 incorporates centering mechanisms to ensure that both the upper and lower selector mechanisms 72 and 74 are properly positioned with respect to a selected bin. This will ensure that the second bevel gear 114 will properly engage the rotor 76 of the selected bin. The forward transverse wall of each of the trays, such as wall 66 of the lower tray 32 (FIG. 2), is provided with a series of positioning holes 120 adjacent the upper edge thereof.

As shown in FIG. 8, each of the holes 120 is countersunk outwardly for receiving the tapered forward end of a locator tab 122. Referring to FIG. 6, the rear end of the locator tab 122 is connected to a guide block 124. The locator tab 122 slides within a slot 126 in the box-like gear housing 74. The guide block 124 has a channel 128 formed in the underside thereof which receives a guide pin 130 which extends upwardly from the bottom wall **104*g* of the gear housing 104. The upper side of the guide block 124 slides under a cut-out region 112*a* in the cylindrical bushing 112 which rotates with the drive shaft 106**.

The locator tab 122 cannot slide through the slot 126 to its inward position illustrated in FIG. 6 unless the drive shaft 106 is rotated to the position the cut-out region 112*a* of the cylindrical bushing 112 directly over the guide block 124. The guide block 124 has a sloped upwardly extending projection 124*a*. A wire spring 132 (FIG. 8) extends through the guide block 124 transverse to its longitudinal axis. The ends of the wire spring 132 are secured in holes in the opposite side walls 104*a* and 104*b* of the box-like gear housing 104. The wire spring 132 urges the locator tab 122 toward the forward wall 66 of the snack tray 32.

As the lower selector mechanism 74 is moved laterally by manually sliding the selection lever 96 (FIG. 3) the forward tapered end of the locator tab 122 engages the forward transverse wall 66 of the lower tray 32. When the selector mechanism 74 is properly aligned with a selected bin, the forward tapered end of the locator tab 122 will enter the counter-sunk hole 120 as illustrated in FIGS. 6 and 8. When the locator tab 122 is in its inserted position as illustrated in FIG. 6, the guide block 124 will also be in its right or inward position. In this position the sloped projection 124*a* is clear of the cylindrical bushing 112, permitting the drive shaft 106 to be rotated through manual actuation of the lower coin mechanism 70. When the selection lever 96 and the lower selector mechanism 74 are manually slid laterally between bins, the tapered end of the locator tab 122 engages the surface of the forward transverse wall 66, pushing the guide block 124 outward to the left in FIG. 6. This positions the sloped projection 124*a* directly beneath the cut-out region 112*a* of the cylindrical bushing 112, thus preventing rotation of the drive shaft 106.

The wire spring 132 (FIG. 8) functions to urge the guide block 124 and locator tab 122 toward the tray 32. Thus, the wire spring 132 causes the tapered forward end of the locator tab 122 to move into one of the counter-sunk positioning holes 120 in the forward transverse wall 66 of the lower tray 32. This happens as soon as the lower selector mechanism 74 is properly registered with the selected bin. When the lower selector mechanism 74 is moved laterally between bins, the tapered end of the locator tab 122 rides against the transverse wall 66. This forces the locator tab 122 and the guide block 124 outward to the left in FIGS. 6 and 8. This in turn positions the sloped projection 124*a* of the guide block 124 in the cut-out 112*a* of the cylindrical bushing 112. When the sloped projection 124*a* is in this position it prevents rotation of the drive shaft 106. The customer is thereby prevented from rotating handle 144 on the lower coin mechanism 70 unless a proper drive coupling has been established between the lower selector mechanism 74 and the rotor 76 of one of the bins of the lower tray 32. This cooperation of parts ensures that the customer does not lose his or her money without getting a snack.

Figure 5:
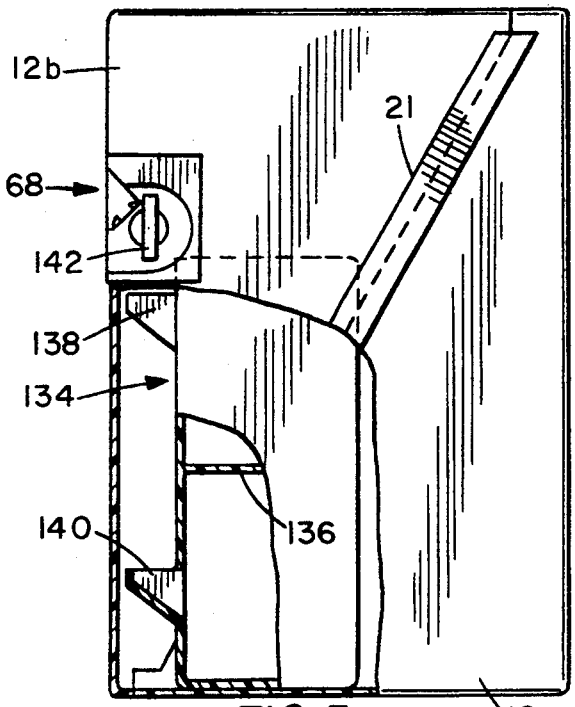
FIG. 5 is an end elevation view, taken from the right side of FIG. 1, of the preferred embodiment of our counter-top vending machine with portions cut away to illustrate the removable coin box.

Referring to FIGS. 2 and 5, the preferred embodiment of our counter-top vending machine 10 includes a generally rectangular hollow coin box 134. This coin box is removably received inside the housing 12 between the right sidewall 26 and the right end walls of the base portion 12*a* and lid portion 12*b* of the housing 12. As best seen in FIG. 5, the coin box 134 has an internal divider 136 which separates the hollow interior of the coin box into upper and lower compartments. Each compartment receives coins from a corresponding one of the upper and lower coin mechanisms 68 and 70. The coin box 134 also includes upper and lower angled coin chutes 138 and 140 which communicate with the upper and lower compartments of the coin box. The coin chutes 138 and 140 are positioned on the coin box such that when the coin box is installed into the base portion 12*a* of the housing 12, the chutes lie directly beneath the corresponding upper and lower coin mechanisms 68 and 70 for receiving coins which drop out of the same when manually actuated by rotary movement of handles 142 and 144 (FIG. 1).

As best seen in FIG. 2, the coin box 134 is preferably constructed to provide two half sections 134*a* and 134*b* which are connected together by a rear hinge (not illustrated). These half sections 134*a* and 134*b* of the coin box are preferably held together by a small pad lock (not illustrated) having a shackle which extends through holes in a pair of tabs (not illustrated) formed on the half sections 134*a* and 134*b*. Thus, the preferred embodiment of our counter-top vending machine 10 has two levels of security. First of all, the lid portion 12*b* is locked to the base portion 12*a* by lock 29 (FIG. 1). Only the route driver has the key for the lock 29. Customers are therefore prevented from gaining access to the hollow interior 14 of the housing 12. However, in order to ensure that the route driver does not have direct access to the coins which have been received by the vending machine 10, the coin box 134 is locked with a pad lock. Preferrably the coin chute openings are narrowed at their lower ends to prevent the route driver from shaking out the coins. This construction is much like a piggy bank and is not illustrated in the drawing figures. The route driver can only remove the coin box 134 and deliver it back to the appropriate person at the vending machine company who then opens the coin box and counts the coins stored therein. The person who counts the money also keeps a separate accounting of the coins dropped from the upper coin mechanism 68 and the coins dropped from the lower coin mechanism 70. These reflect the sales for the upper and lower snack trays 30 and 32, respectively. The coin box 134 is removed simply by sliding it outwardly from the housing 12 (to the left in FIG. 5).

Figure 13:
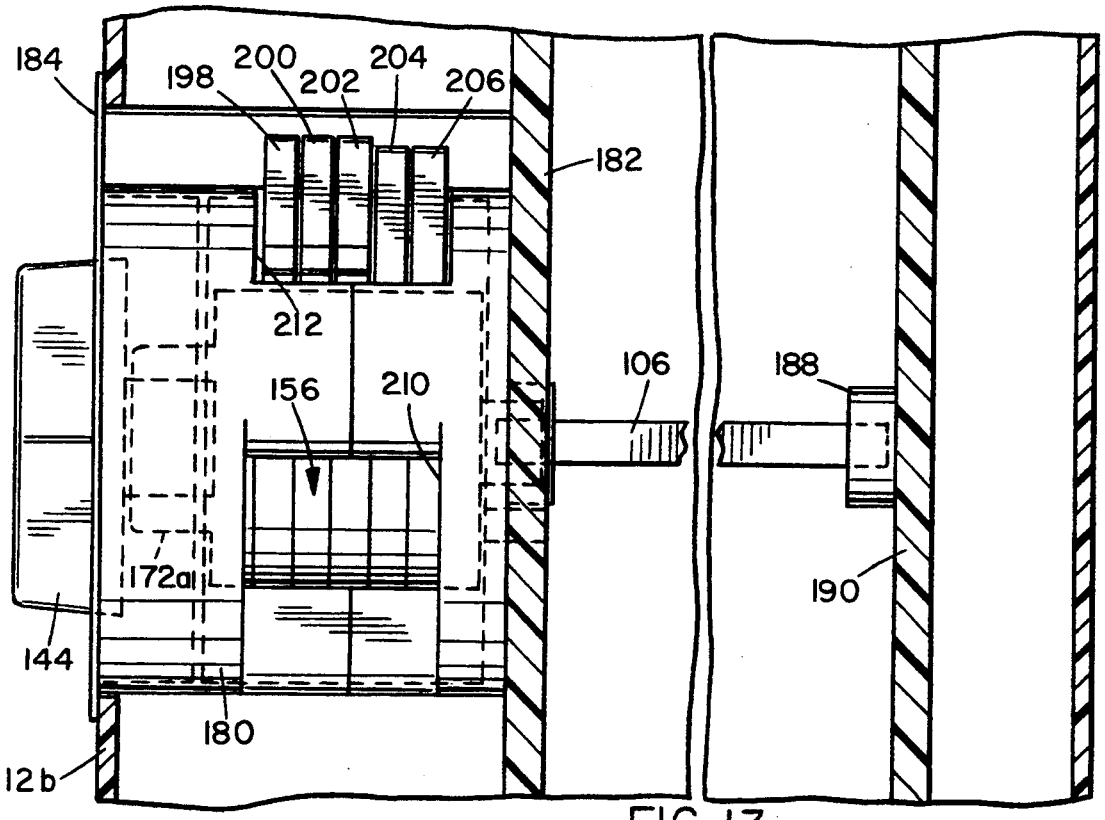
FIG. 13 is an enlarged vertical sectional view taken along line 13—13 of FIG. 10 showing the rear side of the coin mechanism in elevation along with the mounting of the drive shaft.
Figure 14:
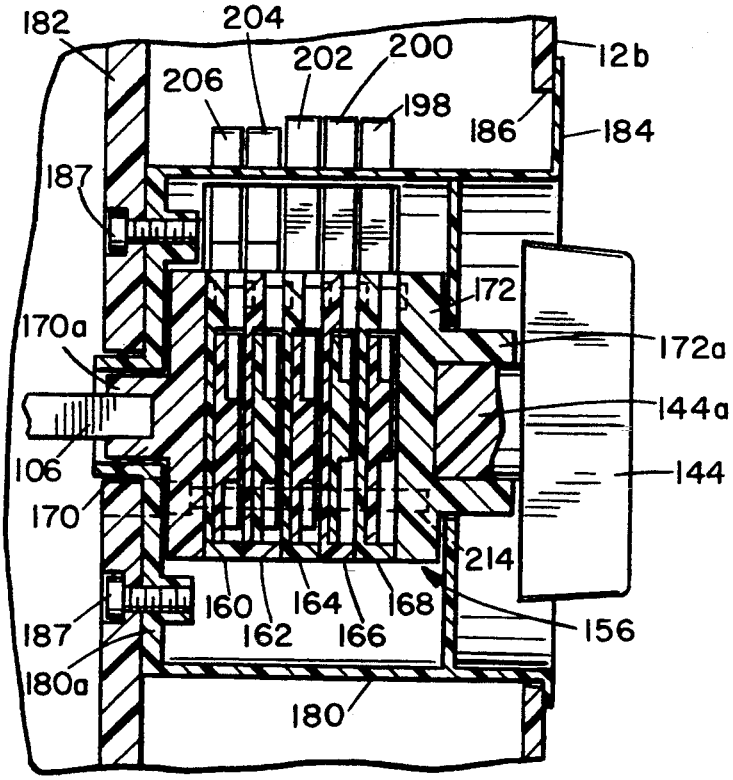
FIG. 14 is a vertical sectional view of the coin mechanism taken along line 14—14 of FIG. 11.

Details of the construction of the lower coin mechanism 70 will now be described by way of reference to FIGS. 7–14. It will be understood that the upper coin mechanism 68 has an identical construction. The coin mechanism 70 (FIG. 9) is mounted to the exterior corner of the lid portion 12*b* of the housing 12. The coin mechanism 70 contains five slots 146, 148, 150, 152 and 154 for receiving individual coins such as nickels, dimes and quarters. The coin slots are formed in a drum 156 (FIG. 14). The drum 156 has an overall cylindrical configuration and is comprised of five individual coining disks 158, 160, 162, 164 and 166 which are sandwiched together between a pair of end caps 170 and 172. The construction of each of the coining disks is identical.

Figure 11:
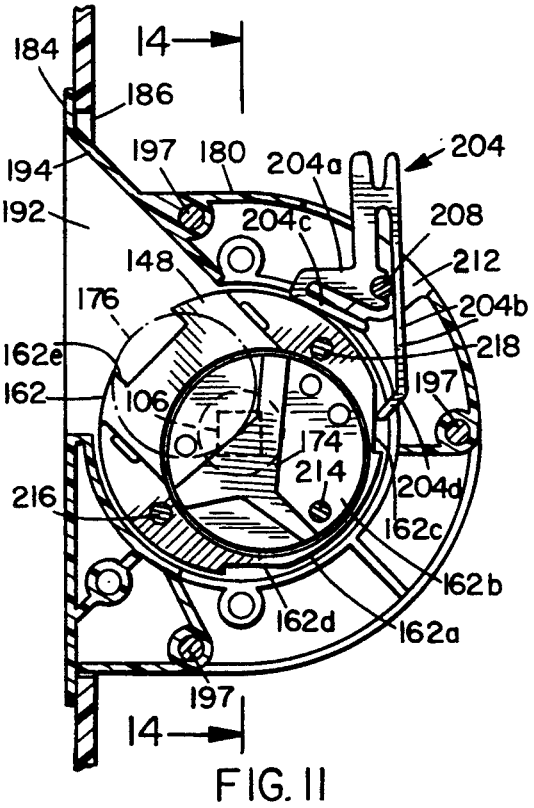
FIG. 11 is a vertical sectional view of the coin mechanism taken along line 11-11 of FIG. 9. In this view, the lock pin for one coin slot is shown in the active position.

Referring to FIG. 11, the coining disk 162 comprises an outer holder portion 162*a* and an inner coining disk portion 162*b*. The outer holder portion 162*a* has an eccentrically located circular recess for receiving and holding the inner coining disk portion 162*b*. The coining disk portion 162*b* has a three-pronged projection 174. The arms of the three-pronged projection 174 extend generally radially outward relative to the coining disk portion 162*b*. These arms are positioned to define three separate receptacles, each sized for receiving a different coin. By way of example, one receptacle is sized for receiving a nickel 176 shown in phantom lines. Another receptacle is sized for receiving a dime. A third receptacle is sized for receiving a quarter. The prong 178 (FIG. 12) is positioned as shown to block entry of a coin when that coin slot is de-activated.

The holder portion 162*a* (FIG. 11) defines the slot 148 (FIG. 9) for receiving a coin into the nickel receptacle. It will be understood that the coin mechanism 70 can be "coined" by rotating each of the coining disk portions of each of the coining disks 158, 160, 162, 164, 166 and 168 to initially place the appropriate receptacle in alignment with the slot in the corresponding outer holder portion of the coining disk. All of the coining disks are then assembled in alignment between the end caps 170 and 172 and are secured together by screws 214, 216 and 218 (FIG. 14). After the coin mechanism is assembled, a flat key (not shown) is inserted into each slot in order to rotate the coining disk portions during re-coining. The key is moved to spin the coining disk portions.

The inner end cap 170 (FIG. 14) has a socket 170*a* with a square hole which receives the right end of the drive shaft 106. The other end cap 172 also has a socket 172*a* which has a round hole for snugly receiving the circular shaft 144*a* of the handle 144.

The coin mechanism 70 has an outer cylindrical housing 180 (FIG. 11) which encloses the cylindrical drum 156. An inner wall 180*a* of the cylindrical housing 180 is secured to a narrow side wall 182 (FIG. 14) mounted in the lid portion 12*b* of the housing. The coin mechanism 70 further includes an L-shaped mounting bezel 184 (FIG. 1) which overlaps the exterior corner surface of the lid portion 12*b* of the housing. As best seen in FIG. 14, the lid portion 12*b* of the housing 12 has an aperture 186 formed therein for receiving the coin mechanism 70. The edges of the L-shaped mounting bezel 184 overlap the edges of the lid portion 12*b* that define the aperture 186. The coin mechanism 70 is secured to the narrow side wall 182 in the lid portion 12*b* by screws 187 (FIG. 14). The left end of the drive shaft 106 is received in a circular hole in a bearing 188 (FIG. 13) which is secured to another narrow side wall 190 mounted in the lid portion 12*b* of the housing 12.

The front of the cylindrical housing 180 of the coin mechanism 70 has a rectangular opening 192 (FIG. 9 and 10) which exposes the coin slots 146, 148, 150, 152 and 154. The opening 192 permits coins, such as the nickel 176 (FIG. 10) to be inserted into the corresponding coin slot. Preferably, adhesive labels (not illustrated) are applied vertically to the exterior of the mounting bezel 184 directly below each of the coin slots 146, 148, 150, 152 and 154 to indicate the denomination of coin to be inserted into the corresponding slot. These adhesive labels are each aligned with the coin slots.

Figure 9:
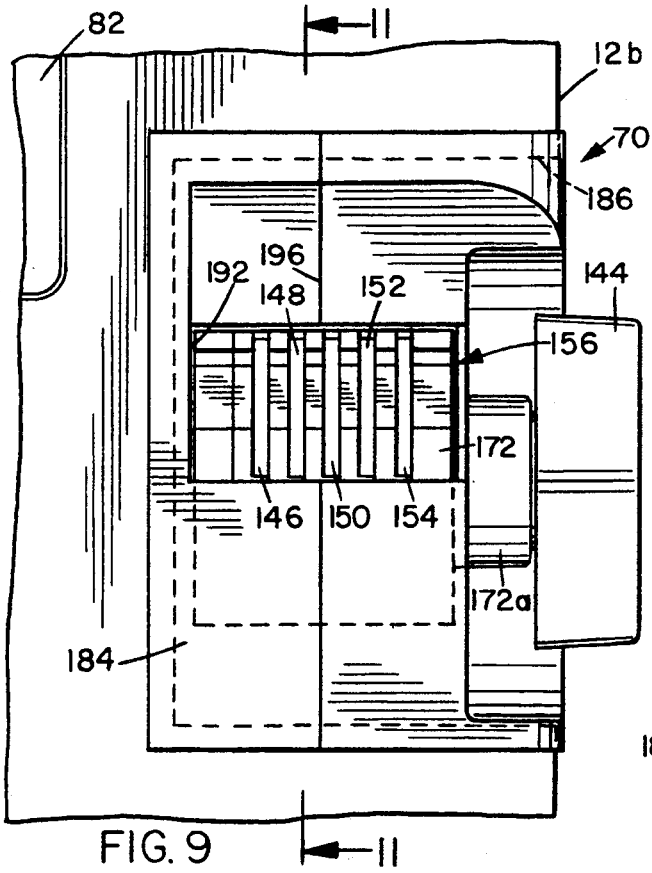
FIG. 9 is an enlarged elevation view of one of the coin mechanisms of the preferred embodiment of our counter-top vending machine.

As best seen in FIG. 11, the cylindrical housing and mounting bezel 184 are joined with a sloped surface which provides access to the coin receiving opening 192. Preferably, both the cylindrical housing 180 and the mounting bezel 184 are molded out of plastic as a two-piece assembly having a part line 196 (FIG. 9). The two half sections can be joined together around the drum 156 and its coining disks. The half sections are held together by the screws 197 (FIG. 11).

Each of the slots of the coin mechanism 70 has a lock pin associated therewith. More specifically, referring to FIG. 13, lock pins 198, 200, 202, 204 and 206 are illustrated. Each of the lock pins has an identical construction and therefore only details of the lock pin 204 will be described. Referring to FIG. 11, the lock pin 204 is shown mounted in the coin mechanism 70 in its active position. The lock pin 204 has a generally Y-shaped main portion 204*a* with a semi-circular recess that fits around a mounting rod 208. The mounting rod 208 extends transversely through the cylindrical housing 180. The lock pin 204 further has a main pawl 204*b* and a minor pawl 204*c*. The proximal ends of these pawls 204*b* and 204*c* are connected to the legs of the Y-shaped portion 204*a*. Preferably, the entire lock pin 204 is molded as one single piece of plastic so that the pawls 204*b* and 204*c* are flexible and resilient.

When the lock pin 204 is mounted in its active position illustrated in FIG. 11, the bent distal end 204*d* can engage one of a pair of ratchet surfaces 162*c* and 162*d* formed in the holder portion 162*a* of the coining disk 162. The main pawl 204*b* thus prevents counter-clockwise rotation of the drum 156 using the handle 144. Rotation in this direction might enable the customer to retrieve coins that have already been inserted, after the drum 156 has been rotated clockwise a sufficient amount to dispense a snack.

In the field it has been observed that some customers are able to rotate the handle 144 counter-clockwise with sufficient force to bend the main pawl 204*b* to thereby snap its distal end past the ratchet surface 162*c*. To prevent this, a sixth lock pin (not shown) can be installed in the housing 180 on the rod 208. It has a hook configuration with a thick rigid leg whose distal end engages a ratchet surface on the end cap 170.

When a coin such as nickel 176 is inserted into the coin slot 148 and the drum 156 is rotated by turning the handle 144, the coin 176 will operate as a cam. The nickel 176 engages the minor pawl 204*c* and slightly rotates the lock pin 204 clockwise in FIG. 11. In this position, the forward shoulder of the minor pawl 204*c* will clear a shoulder 162*e* on the holder portion 162*a* of the coining disk 162. This will permit continued clockwise rotation of the drum 156 until the coin can drop out of a lower opening 210 (FIG. 13) in the rear of the cylindrical housing 180 and into the corresponding chute of the coin box 134. If no coin is inserted into the slot 148 the leading end of the minor pawl 204*c* will strike the shoulder 162*e* and prevent further clockwise rotation of the drum 156. This prevents the shaft 106 from being rotated enough to turn a helical coil in one of the bins a sufficient amount to dispense a snack. It will thus be understood that the proper denomination of coin must be inserted into each coin slot which has its lock pin in the active position. Otherwise, the active lock pin or lock pins will prevent a full resolution of the drum 156 that would result in the dispensing of a snack.

Figure 12:
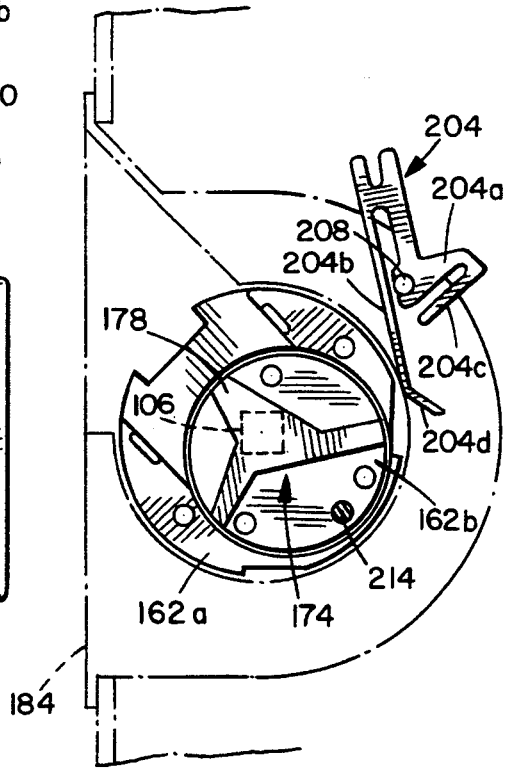
FIG. 12 is a vertical sectional view of the coin mechanism similar to FIG. 11 except that the lock pin is shown in its inactive position.
Figure 10:
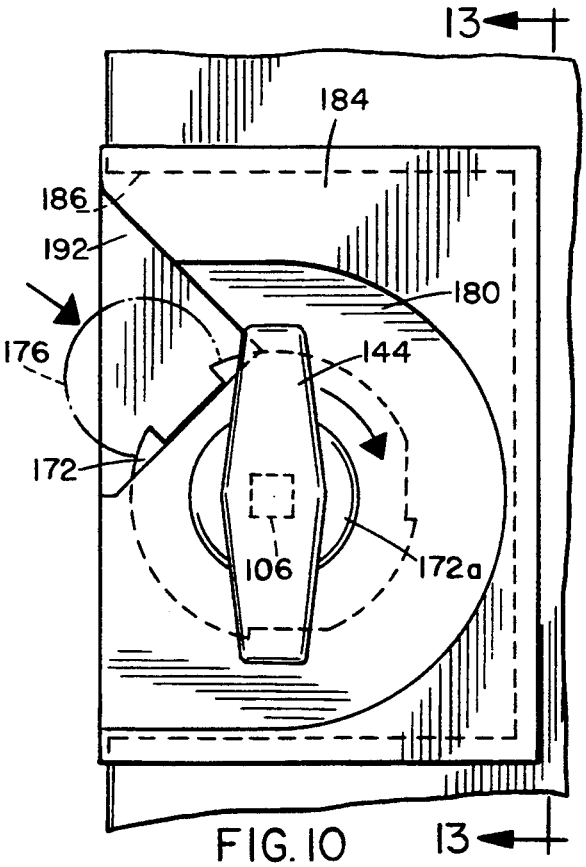
FIG. 10 is a side elevation view of the coin mechanism taken from the right side of FIG. 9.

FIG. 12 shows the inactive position of the pawl 204 in which it is reversed and remounted on the rod 208. In this position, neither the main pawl 204*b* nor the minor pawl 204*c* can engage the ratchet surfaces 162*c* or 162*d* or the shoulder 162*e* to prevent clockwise rotation of the drum 156. Coin slots in the coin mechanism which are not needed to make the total sales price have their lock pins set to the inactive position. Access to the lock pins is gained through an upper opening 212 (FIG. 11) in the rear of the cylindrical housing 180. In FIG. 13, the lock pins 198, 200 and 202 are shown in their inactive positions. The lock pins 204 and 206 are shown in their active positions.

As seen in FIGS. 11 and 12, three screws 214, 216 and 218 hold the five coining disks 158, etc. together. Of these three screws, only the screw 214 passes through each of the inner coining disk portions such as 162*b*. Bearing this in mind, the "re-coining" of the coin mechanism 70 can now be described. First of all, the drum 156 is placed in its "ready for money" position shown in FIG. 9 in which all five of the coining slots 146, etc. are visible through the opening 192. The single coining screw 214 (FIG. 14), which passes through the five coining disk portions such as **162*b*, is removed by placing a screw driver through aligned apertures in the inner wall 180*a* of the cylindrical housing 180 and the side wall 182. Once the coining screw 214 has been removed, each coin slot can be activated, deactivated or its value changed. Activation or deactivation involves orienting the lock pins, such as 204, between the active position shown in FIG. 11 and the inactive position shown in FIG. 12. Changing the coin value involves insertion of the flat key (not shown) into the corresponding coin slot, such as 148 (FIG. 11) and holding the three-pronged projection 174 while the handle 144** is rotated.

The construction of our coin mechanisms permits ninety-degree rotation via the handles even after the coins have dropped into the coin box. Thus, if a snack hangs up on the end of a coil, the handle can be moved back and forth by the customer to free the snack. This is referred to as a "kick off" motion.

The identical coin mechanisms 68 and 70 are preferably each made of injection molded plastic parts, except for the screws and the mounting rod 208. The upper coin mechanism 68 can be coined for higher priced snacks stored in the upper try 30. The lower coin mechanism 70 can be coined for a priced snacks stored in the lower tray 32. The trays are preferably made of molded plastic.

The illustrated embodiment of our vending machine does not employ any electrical mechanisms. It is relatively light, e.g. less than thirty-five pounds without any snacks stored thereon. It can be sold for $300.00 or less. Only two coin mechanisms need ever be re-coined, as opposed to prior art non-electric vending machines that have utilized one coin mechanism for each bin. Our unique coin mechanisms are inexpensive, reliable and easy to re-coin without any additional parts.

While we have described a preferred embodiment of our counter-top vending machine, it should be understood that modifications and adaptations thereof will occur to persons skilled in the art. For example the trays could be fixed. The housing could be made roughly one-half as tall as that illustrated in order to include only a single tray and coin mechanism. The result would be a much more compact counter-top vending machine still offering the same advantages as those of the illustrated two-tier machine but providing less snack item capacity and variety. Various modifications of the bin configuration could be utilized. A different coin mechanism could be substituted for the one illustrated. The selector and drive mechanisms could be modified to adapt to a different housing configuration. Also, while our vending machine is primarily designed to dispense edible snack items, it could dispense a wide variety of inedible items such as toys, medications, toiletries, hardware and packaged fishing tackle. Therefore, the protection afforded our invention should only be limited in accordance with the scope of the following claims.

We claim:

1. A vending machine, comprising:

a housing having a hollow interior and a manual retrieval opening;

a tray supported by the housing inside the interior thereof, the tray having a plurality of storage bins, each bin being dimensioned for receiving a plurality of items to be dispensed and having means for ejecting a single unit of the item therefrom including a helical coil and a first drive coupling connected to an end of the coil for rotating the coil about a horizontal axis;

manually operable coin means mounted to an exterior of the housing for receiving a predetermined number and size of coins to thereby permit a single actuation thereof through a predefined range of motion;

manually operable selector means mounted to the exterior of the housing for designating the item to be dispensed when moved into engagement with the ejecting means of a preselected one of the plurality of storage bins; and drive means coupled between the coin means and the selector means for enabling the predefined range of motion imparted by a single actuation of the coin means to actuate the ejecting means of the preselected one of the storage bins to thereby cause a single unit of the item stored therein to be dispensed to the manual retrieval opening of the housing.

2. A vending machine according to claim 1 and further comprising a coin box removably insertable into the interior of the housing for receiving coins from the coin means.

3. A vending machine according to claim 1 wherein the manually operable selector means includes a lever slidable horizontally across the housing.

4. A vending machine according to claim 1 and further comprising a door sized for covering the retrieval opening, and means for hingedly mounting the door to the housing for opening and closing the retrieval opening.

5. A vending machine according to claim 1 wherein the coin means includes a coin receiving drum rotatable through a predefined angle of rotation upon insertion of the proper amount of coins and thereafter partially rotatable to kick off an item hung up on an end of the helical coil.

6. A vending machine according to claim 5 wherein the drive means includes a drive shaft connected to the coin receiving drum and supported by the housing so that the drive shaft extends horizontally across the housing, and a second drive coupling for engaging the first drive coupling of a selected one of the plurality of storage bins by sliding the lever to a position coinciding with the selected storage bin.

7. A vending machine according to claim 1 wherein the housing includes a base portion, a lid portion and means for hingedly connection the base portion and the lid portion so that the lid can be swung upwardly to gain access to the tray.

8. A vending machine according to claim 7 and further comprising means for locking the lid portion to the base portion.

9. A vending machine according to claim 7 and further comprising stay means pivotally connected to the lid portion for engaging the base portion and holding the lid portion in a raised position.

* * * * *